US009613729B2

(12) United States Patent
Shu et al.

(10) Patent No.: US 9,613,729 B2
(45) Date of Patent: Apr. 4, 2017

(54) MECHANICAL DESIGN OF MULTIPLE ZONE PLATES PRECISION ALIGNMENT APPARATUS FOR HARD X-RAY FOCUSING IN TWENTY-NANOMETER SCALE

(71) Applicant: UChicago Argonne, LLC, Chicago, IL (US)

(72) Inventors: Deming Shu, Darien, IL (US); Jie Liu, Lisle, IL (US); Sophie C. Gleber, Oak Park, IL (US); Joan Vila-Comamala, Oak Park, IL (US); Barry Lai, Woodridge, IL (US); Jorg M. Maser, Oak Park, IL (US); Christian Roehrig, Plainfield, IL (US); Michael J. Wojcik, Tinley Park, IL (US); Franz Stefan Vogt, Plainfield, IL (US)

(73) Assignee: UChicago Argonne LLC, Chicago, IL (US)

( * ) Notice: Subject to any disclaimer, the term of this patent is extended or adjusted under 35 U.S.C. 154(b) by 575 days.

(21) Appl. No.: 14/282,281

(22) Filed: May 20, 2014

(65) Prior Publication Data

US 2015/0340114 A1 Nov. 26, 2015

(51) Int. Cl.
*G21K 1/06* (2006.01)
*G21K 7/00* (2006.01)

(52) U.S. Cl.
CPC *G21K 7/00* (2013.01); *G21K 1/06* (2013.01)

(58) Field of Classification Search
CPC ..... G21K 1/06; G21K 1/067; G21K 7/00
See application file for complete search history.

(56) References Cited

U.S. PATENT DOCUMENTS 4,776,696 A 10/1988 Hettrick et al.
5,826,903 A 10/1998 Schiller et al.
5,896,200 A 4/1999 Shu
6,607,840 B2 8/2003 Shu et al.
(Continued)

OTHER PUBLICATIONS

Wojcik et al., Zone Plate Development at the APS: Status and Plans, Jul. 31, 2013, Zone Plate Development at the APS: Optics Workshop, 26 pages, presentation available at http://aps.anl.gov/Users/3Way/presentations.html.*

(Continued)

*Primary Examiner* — David J Makiya
*Assistant Examiner* — John Corbett
(74) *Attorney, Agent, or Firm* — Joan Pennington

(57) ABSTRACT

An enhanced mechanical design of multiple zone plates precision alignment apparatus for hard x-ray focusing in a twenty-nanometer scale is provided. The precision alignment apparatus includes a zone plate alignment base frame; a plurality of zone plates; and a plurality of zone plate holders, each said zone plate holder for mounting and aligning a respective zone plate for hard x-ray focusing. At least one respective positioning stage drives and positions each respective zone plate holder. Each respective positioning stage is mounted on the zone plate alignment base frame. A respective linkage component connects each respective positioning stage and the respective zone plate holder. The zone plate alignment base frame, each zone plate holder and each linkage component is formed of a selected material for providing thermal expansion stability and positioning stability for the precision alignment apparatus.

20 Claims, 11 Drawing Sheets

(56) References Cited

U.S. PATENT DOCUMENTS

| | | | | |
|---|---|---|---|---|
| 6,984,335 | B2 | 1/2006 | Shu et al. | |
| 7,597,475 | B1 | 10/2009 | Shu et al. | |
| 7,731,714 | B2 | 6/2010 | Miyajima et al. | |
| 8,089,199 | B2 | 1/2012 | Shu et al. | |
| 8,526,575 | B1 | 9/2013 | Lyon et al. | |
| 2009/0067976 | A1* | 3/2009 | Xu | H01L 21/68 414/757 |

OTHER PUBLICATIONS

Maser et al, Near-field staking of zone plates in the x-ray range, 2002, SPIE vol. 4783, pp. 74-81.*

* cited by examiner

MECHANICAL DESIGN OF MULTIPLE ZONE PLATES PRECISION ALIGNMENT APPARATUS FOR HARD X-RAY FOCUSING IN TWENTY-NANOMETER SCALE

CONTRACTUAL ORIGIN OF THE INVENTION

The United States Government has rights in this invention pursuant to Contract No. DE-AC02-06CH11357 between the United States Government and UChicago Argonne, LLC representing Argonne National Laboratory.

FIELD OF THE INVENTION

The present invention relates generally to precision positioning stage systems, and more particularly, relates to a method and novel mechanical design of multiple zone plates precision alignment apparatus for hard x-ray focusing in a twenty-nanometer scale.

DESCRIPTION OF THE RELATED ART

Fresnel Zone Plates (FZPs) are widely used optical elements for X-ray focusing and imaging having a wide range of applications in materials science and biology. The FZPs consist of circular diffraction gratings with radially increasing line density, which diffracts and focus the incident X-ray beam into several foci corresponding to different diffraction orders.

Fresnel-zone-plate-based optics is extensively applied for x-ray instruments. At the Advanced Photon Source (APS) at Argonne National Laboratory (ANL), many synchrotron radiation beamlines are using Fresnel zone plates for hard x-ray focusing. However, the efficiency of Fresnel zone plates (FZPs) as focusing optics for x-rays depends on the height of the structures. In the hard x-ray regime, very high aspect ratios are required for maximum efficiency with focusing spot in few tens of nanometers, which is required for future hard x-ray nanoprobe beamlines of a planned APS Upgrade project. Near field stacking of two zone plates has been demonstrated at Argonne National Laboratory (ANL).

To overcome the limitations of today's fabrication techniques for high-efficiency hard x-ray FZPs, stacking of FZPs at larger distances has been proposed. According to one proposed approach, stacking zone plates with large separation distance is possible by adjusting the diameter of the downstream FZP so that its focal length is equal to the focal length of the upstream FZP minus the distance between both FZPs. Thus, the focal spots of both FZPs overlay when the separation of both FZPs includes matching the difference in focal lengths.

However, besides designing and fabricating of high quality FZPs for intermediate-field stacking, there are many mechanical design challenges to transfer the theory to a practical instrument. For example, first of all, a precision alignment apparatus for multiple FZPs handling and aligning must be designed to meet the following challenging design requirements:

Each of the stacking FZPs need to be manipulated in three dimensions with nanometer-scale resolution and several millimeters travel range. The relative three-dimensional stabilities between all of the stacking FZPs, especially in the x-ray beam transverse plane, are required to be kept within few nanometers for more than eight hours, the duration of the hard x-ray focusing for nanoprobe operation. The precision alignment apparatus for multiple FZPs need to be compatible with the operation of multiple optics configurations, for example, for the APS future x-ray nanoprobe design.

A need exists to provide improved mechanical design of multiple zone plates precision alignment apparatus for hard x-ray focusing in a twenty-nanometer scale.

SUMMARY OF THE INVENTION

Principal aspects of the present invention are to provide a mechanical design of multiple zone plates precision alignment apparatus for hard x-ray focusing in a twenty-nanometer scale. Other important aspects of the present invention are to provide such multiple zone plates precision alignment apparatus substantially without negative effect and that overcome some of the disadvantages of prior art arrangements.

In brief, an enhanced mechanical design of multiple zone plates precision alignment apparatus for hard x-ray focusing in a twenty-nanometer scale is provided. The multiple zone plates precision alignment apparatus includes a zone plate alignment base frame; a plurality of zone plates; and a plurality of zone plate holders, each said zone plate holder for mounting and aligning a respective zone plate for hard x-ray focusing. At least one respective positioning stage drives and positions each respective zone plate holder. Each respective positioning stage is mounted on the zone plate alignment base frame. A respective linkage component connects each respective positioning stage and the respective zone plate holder. The zone plate alignment base frame, each zone plate holder and each linkage component is formed of a selected material for providing thermal expansion stability and positioning stability for the precision alignment apparatus.

In accordance with features of the invention, the selected material forming the zone plate alignment base frame includes a nickel-iron alloy, such as invar, also known as FeNi36 or 64FeNi, having a low coefficient of thermal expansion.

In accordance with features of the invention, the selected material forming the zone plate holder includes synthetic diamond having a low coefficient of thermal expansion. One synthetic diamond is chemical vapor deposition (CVD) diamond.

In accordance with features of the invention, the base structure is formed of a selected one of aluminum, and a nickel-iron alloy, such as Invar.

In accordance with features of the invention, each respective positioning stage includes a motorized linear stage including a piezoelectric transducer (PZT) or PZT-driven linear stage. The PZT-driven linear stage includes, for example, an ultrasonic piezo-motor with a linear optical encoder.

In accordance with features of the invention, the zone plates include Fresnel zone plates (FZPs).

In accordance with features of the invention, the base structure includes one of a symmetric invar base structure, and a non-symmetric invar base structure.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1A:
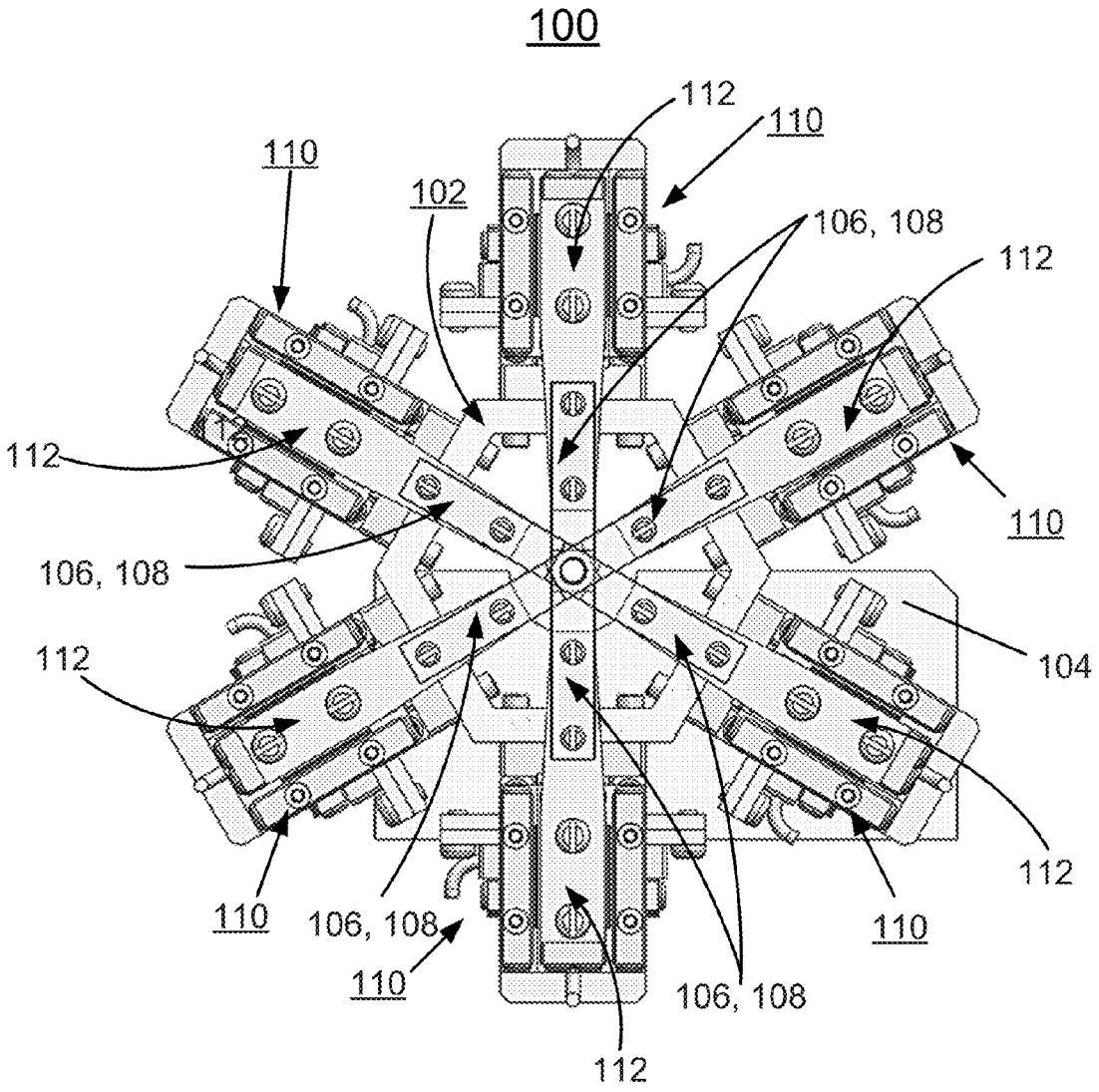
FIGS. 1A, 1B, 2, 3A, 3B, 3C, 4, and 5 schematically illustrate not to scale an example multiple zone plates precision alignment apparatus for hard x-ray focusing in a twenty-nanometer scale including a symmetric frame in accordance with a preferred embodiment.
Figure 1B:
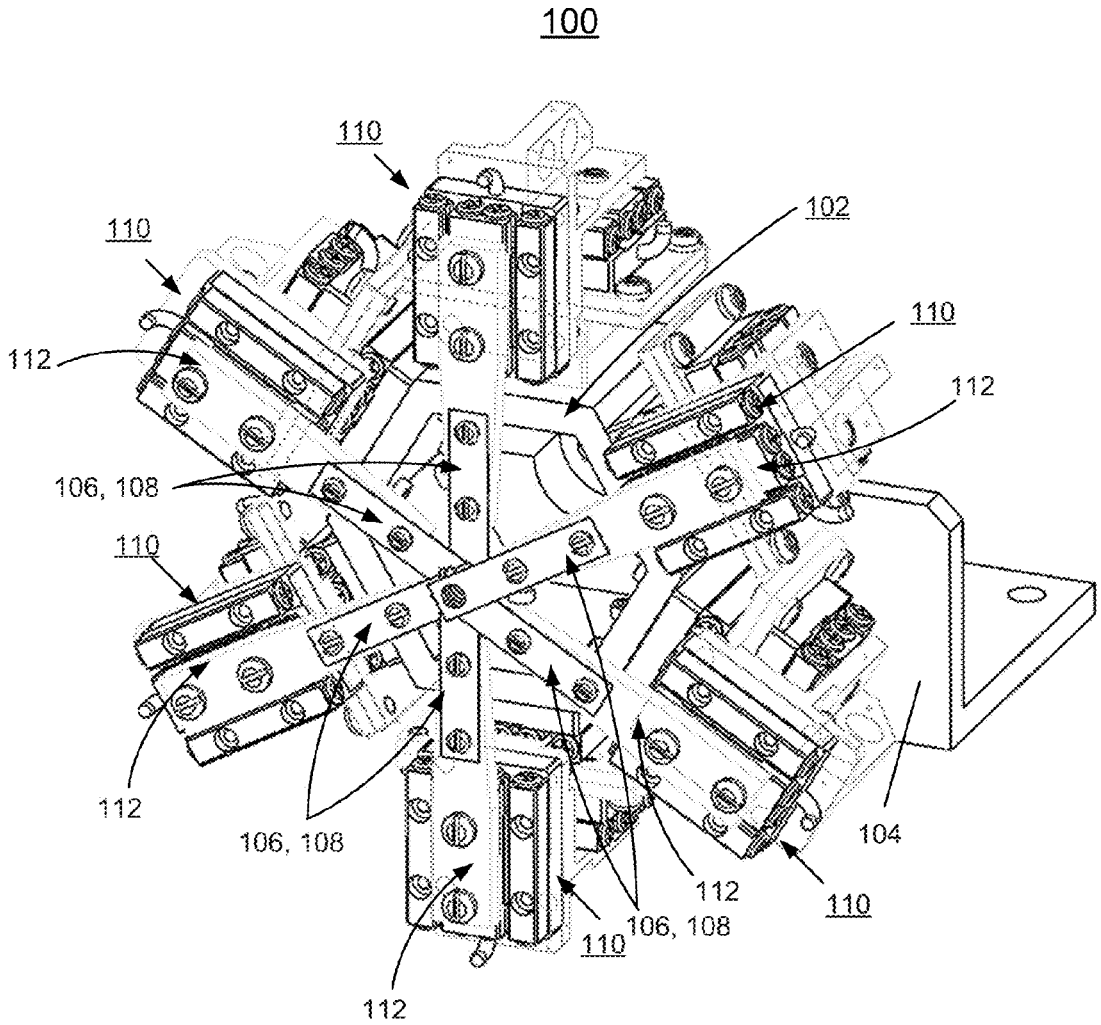

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method and multiple zone plates precision alignment apparatus for hard x-ray focusing in a twenty-nanometer scale are provided.

Having reference now to the drawings, in FIGS. 1A, 1B, 2, 3A, 3B, 3C, 4, and 5, there is shown an example multiple zone plates precision alignment apparatus generally designated by the reference character 100 for hard x-ray focusing in a twenty-nanometer scale including a symmetric frame in accordance with a preferred embodiment.

In accordance with features of the invention, the precision alignment apparatus 100 is designed for six zone plates (ZPs) intermediate field stacking. The precision alignment apparatus 100 is especially useful for hard x-ray focusing with x-ray energy 25 keV and above.

The precision alignment apparatus 100 includes a hexagon symmetric base structure generally designated by the reference character 102 with an interface mounting plate 104. The multiple zone plates precision alignment apparatus 100 includes a plurality of a plurality of zone plate holders 106, six shown, each for mounting and aligning a respective zone plate 108 for hard x-ray focusing. The multiple zone plates precision alignment apparatus 100 includes at least one respective positioning stage generally designated by the reference character 110 driving each of the zone plate holders 106 and at least one linkage component generally designated by the reference character 112, six shown.

It should be understood that the present invention is applicable to other zone plate stacking arrangements for various number of zone plates and is not limited to the illustrated precision alignment apparatus 100. For example, instead of the hexagon symmetric base structure 102, a pentagon symmetric base structure could be used with five zone plates 108 and an octagon symmetric base structure could be used with eight zone plates 108.

Figure 2:
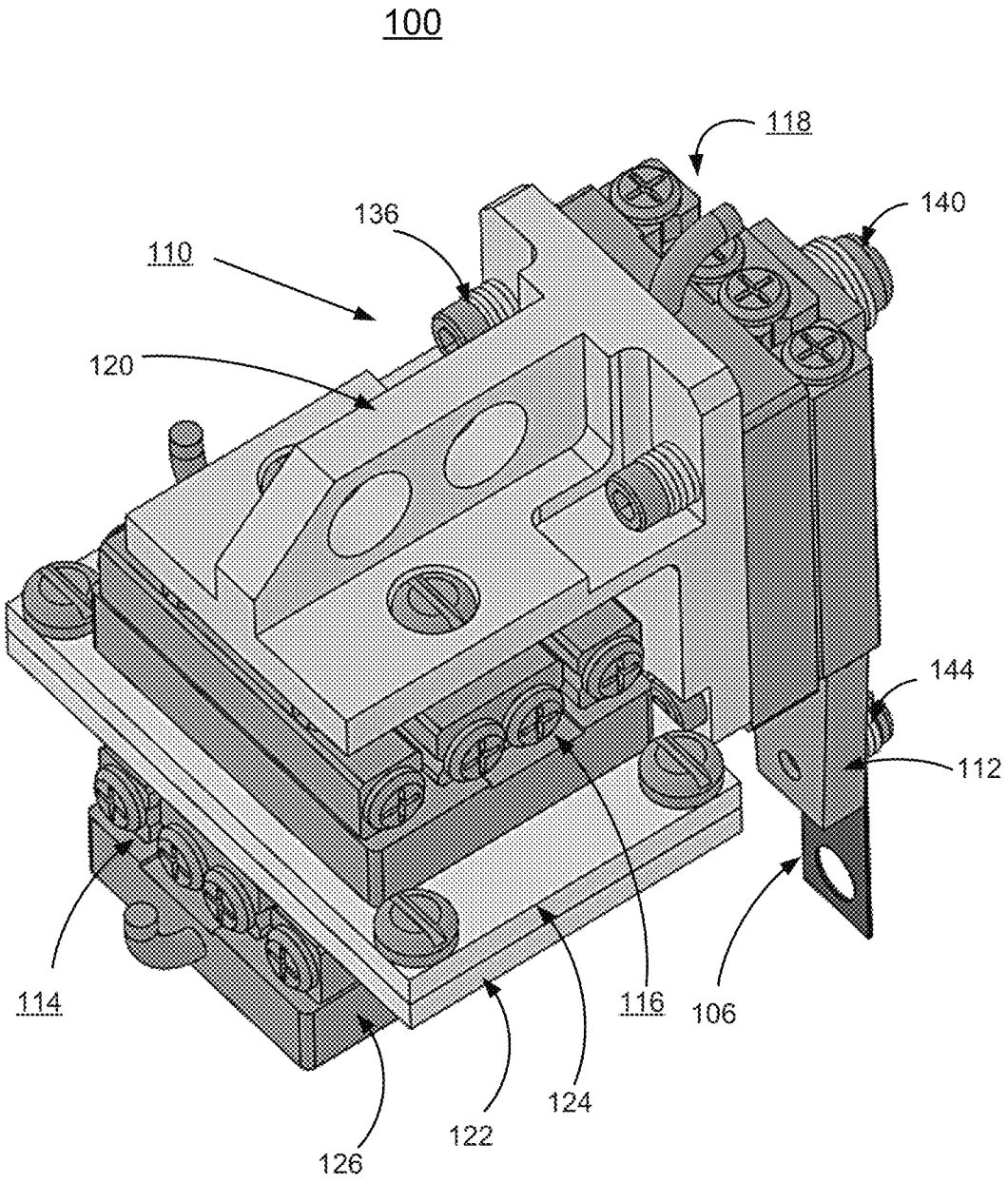
Figure 3A:
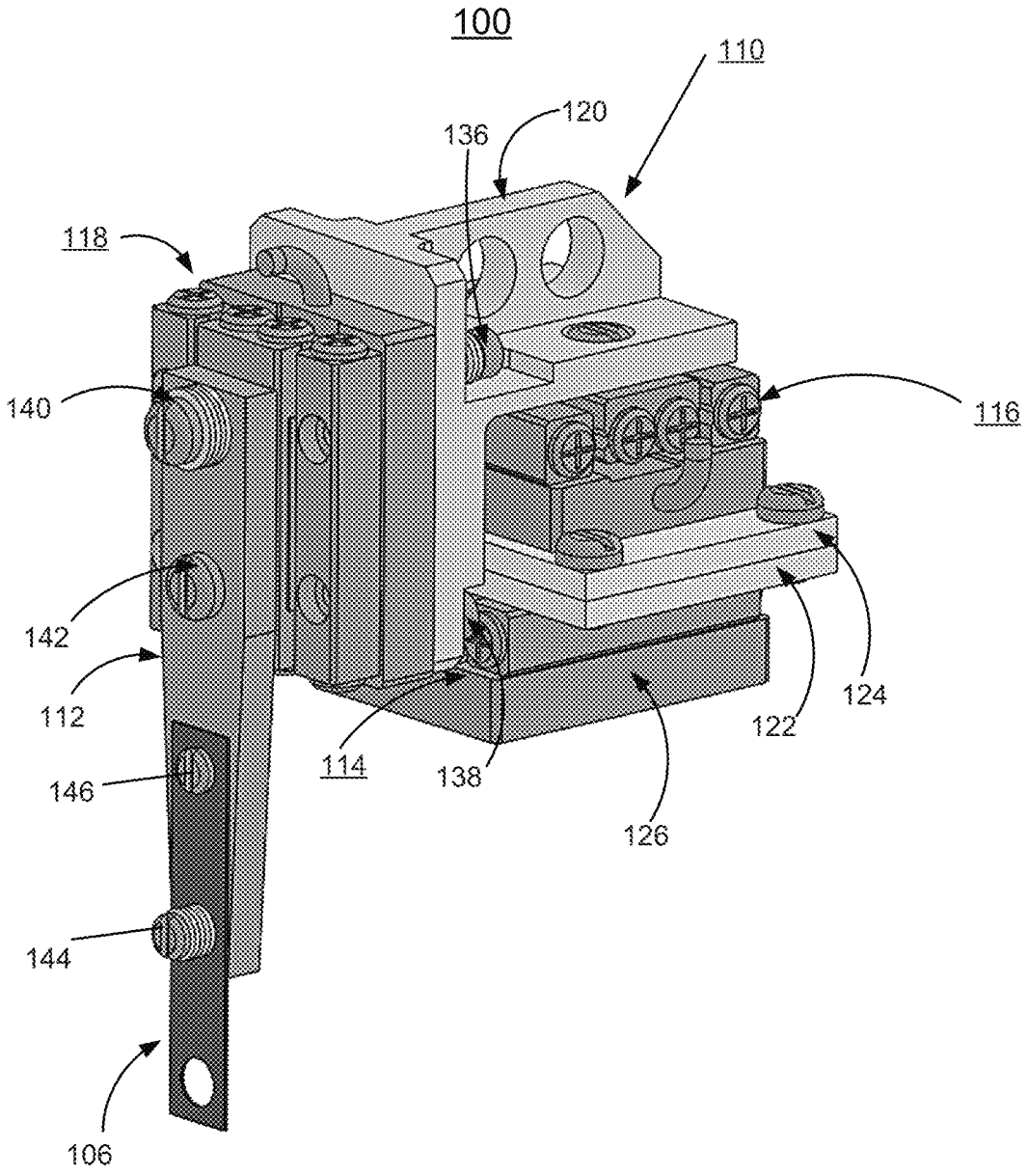
Figure 3C:
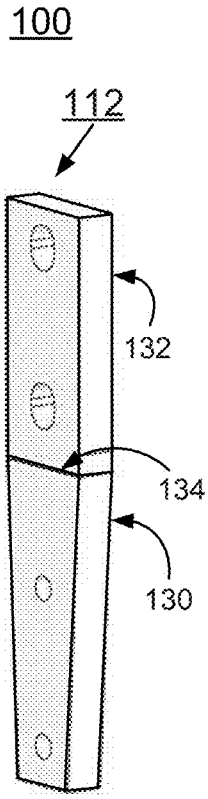
Figure 3B:
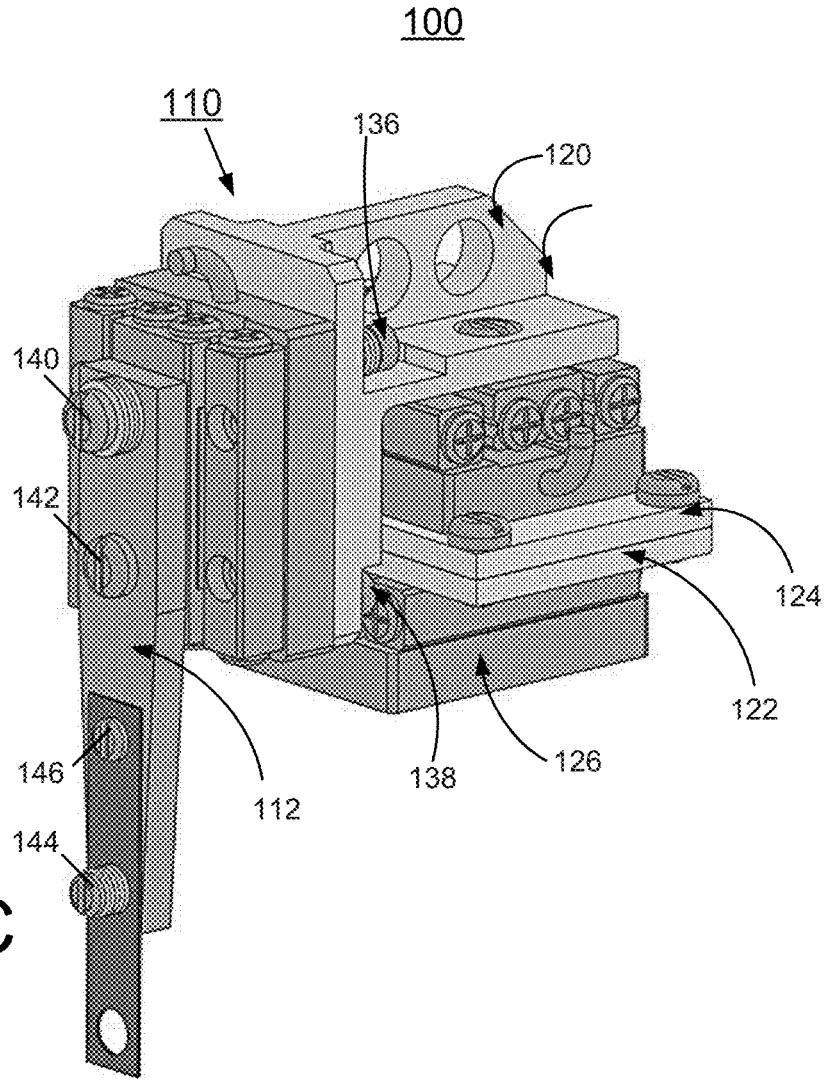
Figure 4:
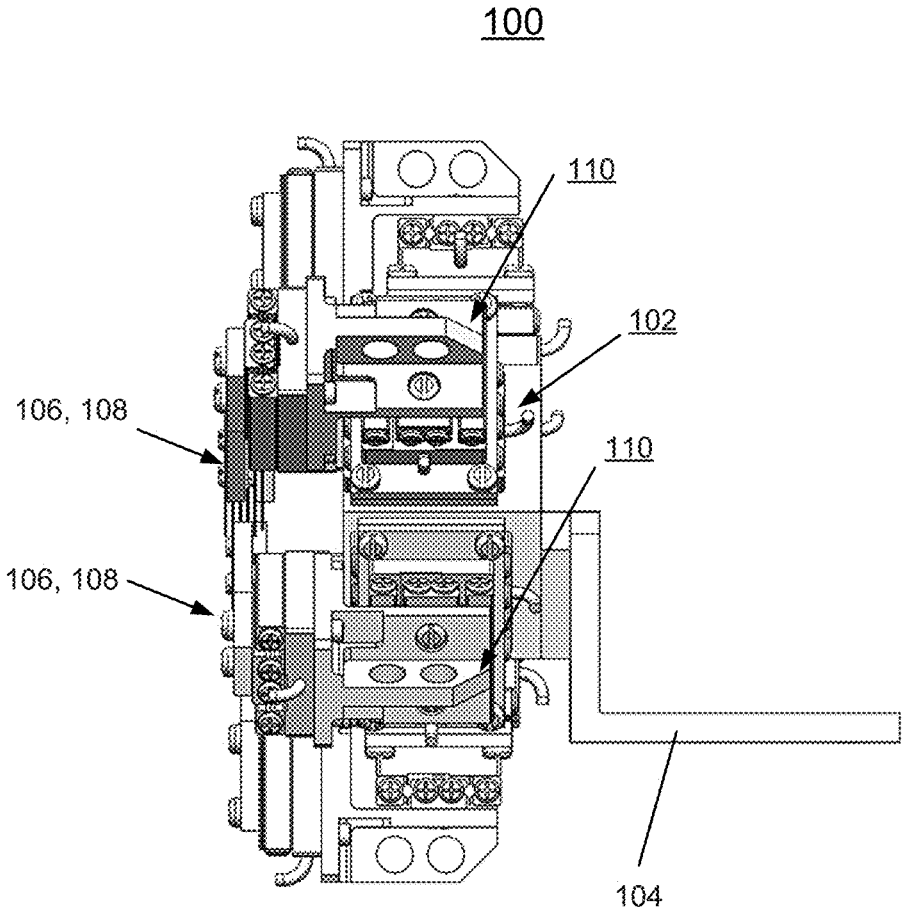
Figure 5:
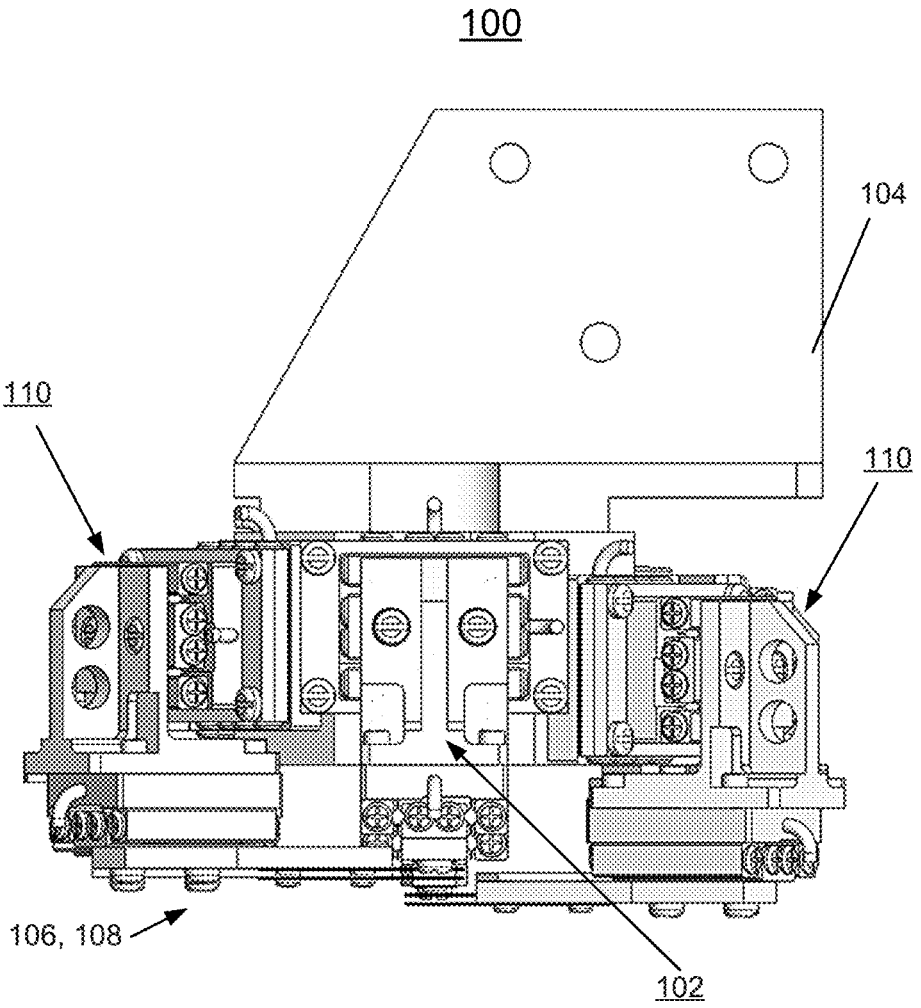
Figure 6:
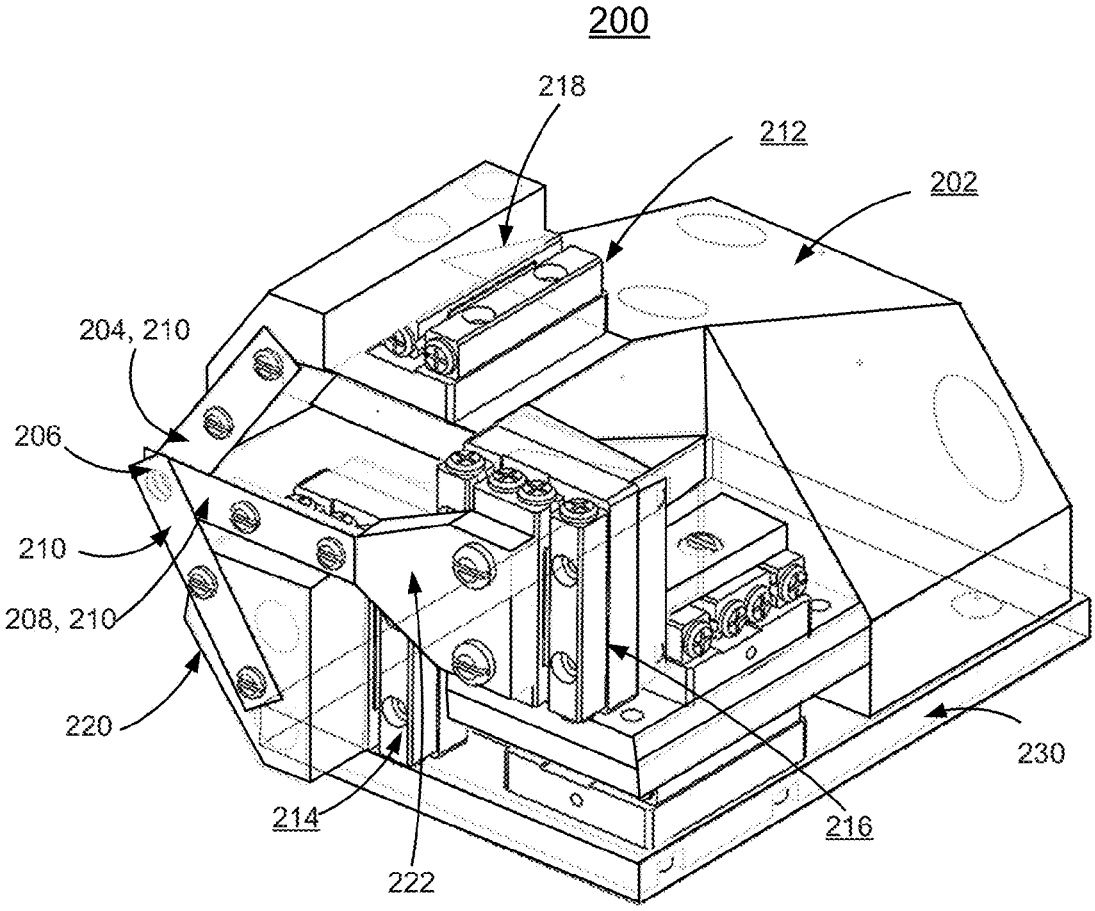
FIGS. 6, 7, 8, and 9 schematically illustrate not to scale another example multiple zone plates precision alignment apparatus for hard x-ray focusing in a twenty-nanometer scale including a non-symmetric frame in accordance with a preferred embodiment.
Figure 7:
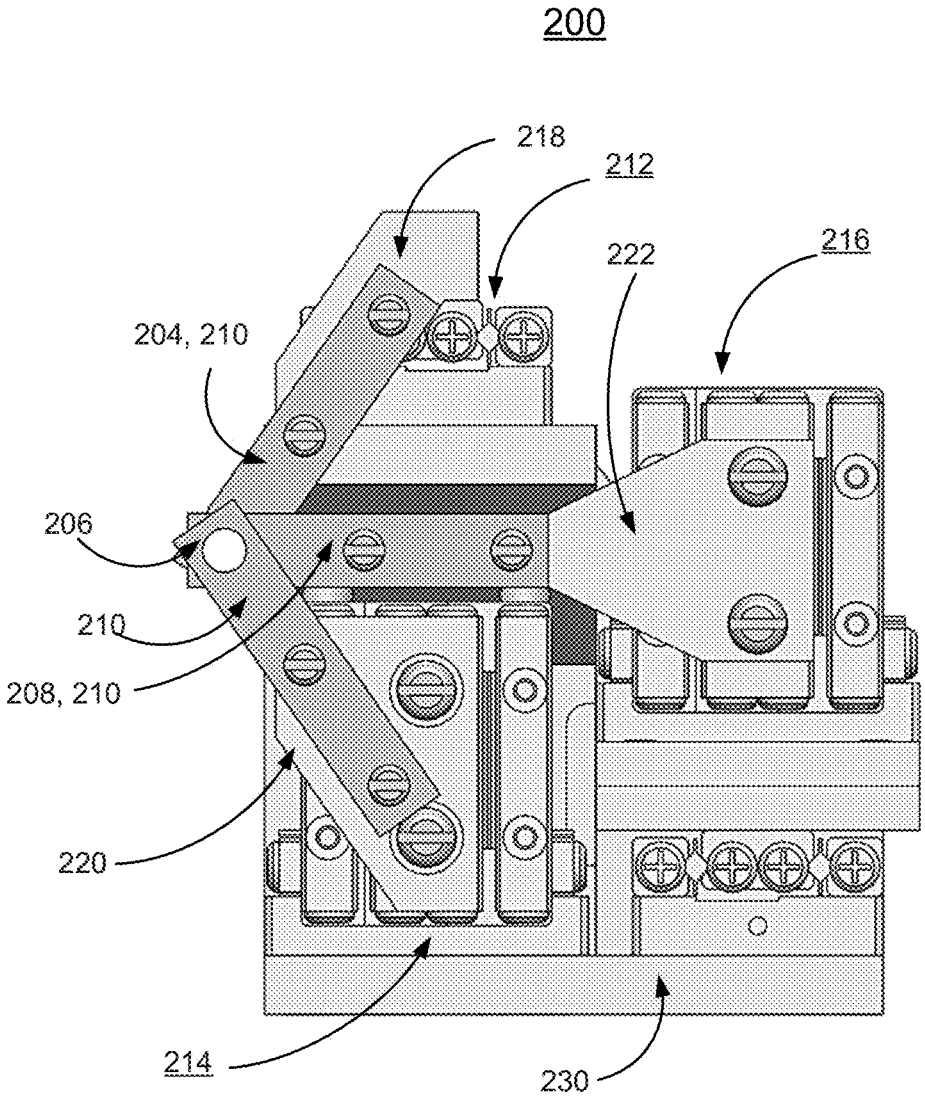
Figure 8:
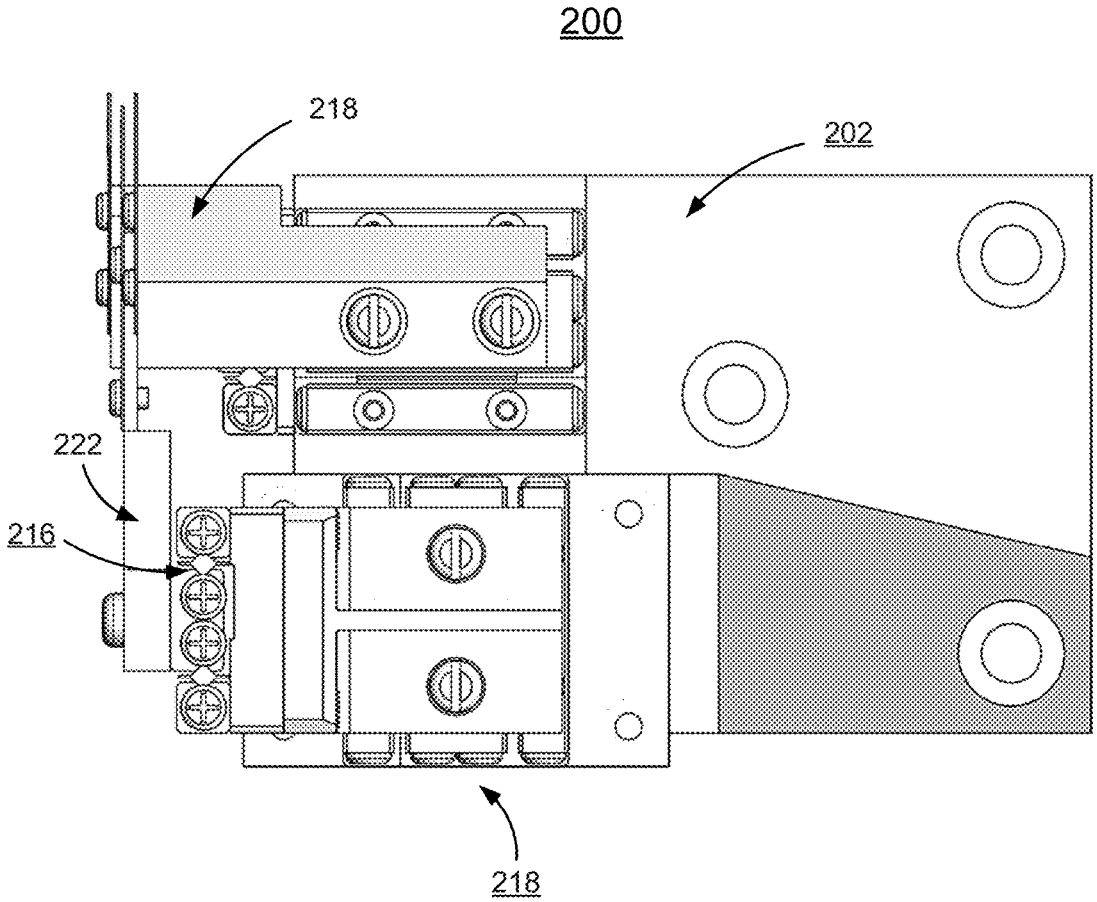
Figure 9:
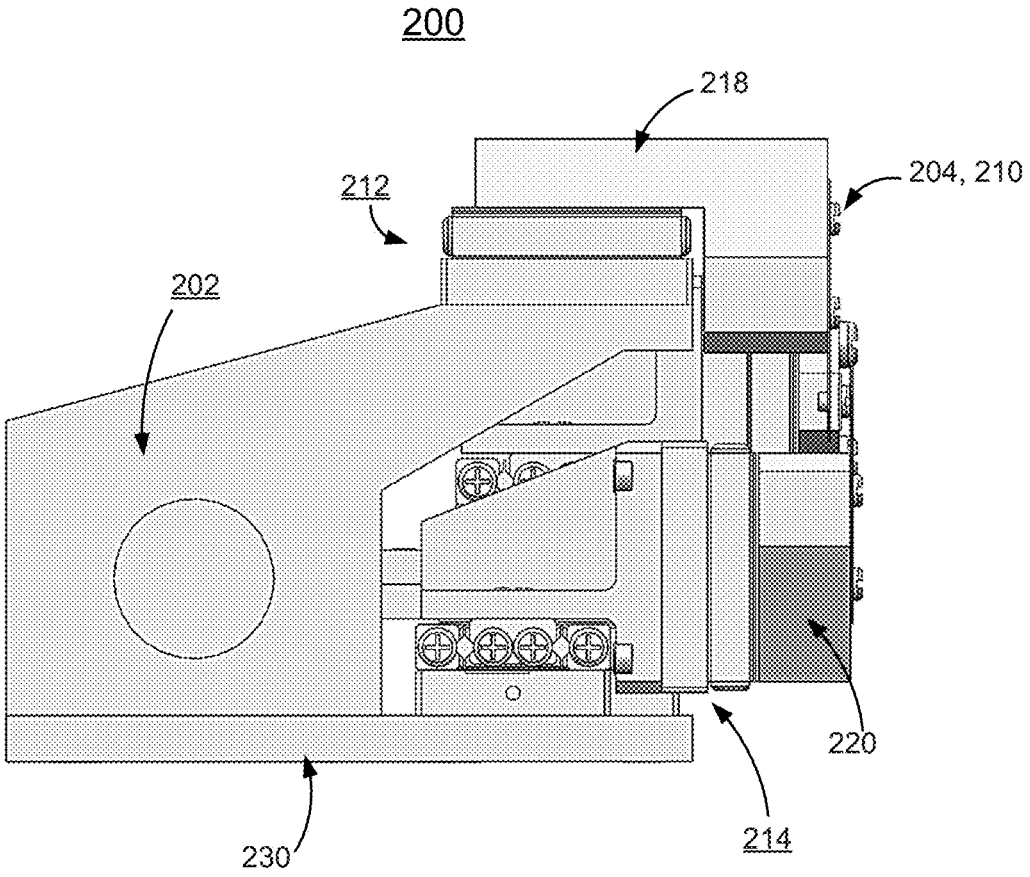

As best seen in FIGS. 2, 3A, and 3B, each respective positioning stage 110 driving the respective six zone plate holders 106 includes three positioning stages 114, 116, 118 or X-Y-Z positioning stages to adjust its position in X, Y, and Z directions and upper frame member 120 and adapter frame members 122, 124.

For example, each of eighteen X-Y-Z positioning stages 110 can be implemented with eighteen commercial Piezomotor-driven linear stages, such as SmarAct™ SLC-1720S, PI™ LPS-24, or Micronix PPS-20 stages.

Each respective positioning stage 110 is mounted on the hexagon symmetric base structure 102 or zone plate alignment base frame 102. Each zone plate alignment base frame 102, each zone plate holder 106 and each linkage component 112 is formed of a selected material providing thermal expansion stability and positioning stability for the precision alignment apparatus.

Referring also to FIG. 3B, a separate view of the linkage component 112 is shown. As shown, the linkage component 112 optionally includes a first holder part 130 and a second holder part 132 with a bonding location indicted by reference character 134. The material or materials of the linkage component parts 130, 132 of each linkage component 112 between the respective positioning stages 110 and the zone plate holders 106 are carefully chosen to achieve thermal expansion compensation. Various bonding techniques can be used to bond the linkage component parts 130, 132, such as brazing, explosive bonding or epoxy bonding.

In accordance with features of the invention, each linkage component 112 is formed of one or more selected materials providing thermal expansion stability and thermal expansion compensation. For example, each linkage component 112 is formed of one or combination of selected materials including a nickel-iron alloy, such as invar, also known as FeNi36 or 64FeNi, having a low coefficient of thermal expansion, Aluminum alloy, such as Aluminum 6061, Titanium, copper alloy, Stainless Steel (SS), such as SS304, and carbon steel, such as carbon steel 436.

Referring now to FIGS. 2, 3A, and 3B, each of the respective positioning stage 110 including three positioning stages 114, 116, 118 include thermal expansion compensation features. For example, a pair of fasteners 136, 138 connects the positioning stage 118 arranged for thermal expansion compensation. The fastener 136 is a spring loaded fastener with spring loading providing a sliding connection and the fastener 138 providing a tight connection without spring loading. Similarly, fastener pairs, 140, 142, and 144, 146 respectively connecting the linkage component 112 to positioning stage 118, and the linkage component 112 to zone plate holder 106 include a spring loaded fastener 140, 144 with spring loading providing a sliding connection and a second fastener 142, 146 providing a tight connection without spring loading.

In accordance with features of the invention, each zone plate holder 106 is formed of a selected material including synthetic diamond, which has a low coefficient of thermal expansion. A synthetic diamond, such as chemical vapor deposition (CVD) diamond forms each zone plate holder 106 in accordance with a preferred embodiment.

In accordance with features of the invention, the hexagon symmetric base structure 102 is formed of a selected frame material including a nickel-iron alloy, such as invar, having a low coefficient of thermal expansion. The interface mounting plate 104 and upper frame member and frame members 120, 122, 124 is formed of a selected frame material including a nickel-iron alloy, such as invar, Aluminum, such as Aluminum 6061, or stainless steel (SS), such as SS 304.

Since the thermal expansion coefficient of CVD diamond is similar to the thermal expansion coefficient of invar, the invar hexagon symmetric base structure 102 and CVD diamond holders 106 basically ensure thermal stability of the apparatus 100. To further compensate the thermal deformation from the stages set, the material or materials of the linkage components 112 between the stages 110 and CVD diamond holders 106 are carefully chosen. Two or three materials optionally are combined to form the linkage components 112 to compensate for stages thermal deformation precisely.

Referring to FIGS. 6, 7, 8, and 9 schematically illustrate not to scale another example multiple zone plates precision alignment apparatus generally designated by the reference character 200 for hard x-ray focusing in a twenty-nanometer scale. The precision alignment apparatus 200 is designed for three zone plates stacking includes a non-symmetric frame 202 compatible for use with mirror-based nanofocusing optics, such as Kirkpatrick-Baez (K-B) mirrors.

The multiple zone plates precision alignment apparatus 200 includes a plurality of three zone plates 204, 206, 208, a respective zone plate holder 210 mounting and aligning a respective zone plate 204, 206, 208 for hard x-ray focusing. The multiple zone plates precision alignment apparatus 200 includes respective positioning stages generally designated by the reference character 212, 214, 216 driving each of the zone plate holders 210. The zone plate holder 210 for upstream zone plate 204 is driven by a stage 212 to adjust its position in Z direction with nanometer scale and stability. The second downstream zone plate 206 is driven by a pair of stages 214 to adjust its position in X and Y directions. The third downstream zone plate 208 is driven by a set of stages 216 to adjust its position in X, Y, and Z directions. A respective linkage component 218, 220, and 222, connect the respective stages to the associated zone plate holder 210, as shown.

For example, the six positioning stages 212, 214, 216 can be implemented with eighteen commercial Piezo-motor-driven linear stages, such as SmarAct™ SLC-1720S, PI™ LPS-24, or Micronix PPS-20 stages.

Each respective positioning stage 212, 214, 216 is mounted on the non-symmetric base structure 202. The frame 202, each zone plate holder 210 and each linkage component 218, 220, and 222 is formed of a selected material providing thermal expansion stability and positioning stability for the precision alignment apparatus.

Each zone plate holder 210 is formed of synthetic diamond, such as chemical vapor deposition (CVD) diamond which has a low coefficient of thermal expansion. The non-symmetric frame 202 is formed of a selected frame material including a nickel-iron alloy, such as invar, also known as FeNi36 or 64FeNi, having a low coefficient of thermal expansion.

Since the thermal expansion coefficient of CVD diamond is similar to the thermal expansion coefficient of invar, the invar non-symmetric base structure 202 and CVD diamond holders 210 basically ensure thermal stability of the apparatus 200. To further compensate the thermal deformation from the positioning stage 212, 214, 216, the material or materials of the linkage components 218, 220, and 222 between the respective positioning stage 212, 214, 216 and the CVD diamond holders 210 are carefully chosen. Two or three materials optionally are combined to form the linkage components 218, 220, and 222 to compensate for stages thermal deformation precisely.

Enhanced mechanical design of multiple zone plates precision alignment apparatus for hard x-ray focusing for intermediate field stacking of five zone plates in accordance with features of the invention has been successfully implemented and tested at Argonne National Laboratory (ANL).

While the present invention has been described with reference to the details of the embodiments of the invention shown in the drawing, these details are not intended to limit the scope of the invention as claimed in the appended claims.

What is claimed is:

1. A multiple zone plates precision alignment apparatus for hard x-ray focusing in a twenty-nanometer scale comprising:

a zone plate alignment base frame;

a plurality of zone plates;

a plurality of zone plate holders, each said zone plate holder for mounting and aligning a respective zone plate for hard x-ray focusing;

at least one respective positioning stage driving and positioning each said respective zone plate holder; each said respective positioning stage being mounted on said zone plate alignment base frame;

a respective linkage component coupling each said respective positioning stage and said respective zone plate holder; and said zone plate alignment base frame, each said zone plate holder and each said linkage component being formed of a selected material for providing thermal expansion stability and positioning stability for the precision alignment apparatus.

2. The multiple zone plates precision alignment apparatus as recited in claim 1 wherein the selected material forming said zone plate alignment base frame includes a nickel-iron alloy having a low coefficient of thermal expansion.

3. The multiple zone plates precision alignment apparatus as recited in claim 2 wherein said nickel-iron alloy includes invar.

4. The multiple zone plates precision alignment apparatus as recited in claim 1 wherein the selected material forming each said zone plate holder includes synthetic diamond having a low coefficient of thermal expansion.

5. The multiple zone plates precision alignment apparatus as recited in claim 4 wherein said synthetic diamond includes chemical vapor deposition (CVD) diamond.

6. The multiple zone plates precision alignment apparatus as recited in claim 1 wherein said synthetic diamond provides predefined stiffness for said zone plate holder.

7. The multiple zone plates precision alignment apparatus as recited in claim 1 wherein the selected material forming each said linkage component includes a combination of selected materials to compensate the stages thermal deformation.

8. The multiple zone plates precision alignment apparatus as recited in claim 1 wherein each said respective positioning stage includes a motorized linear stage including a piezoelectric transducer (PZT) or PZT-driven linear stage.

9. The multiple zone plates precision alignment apparatus as recited in claim 8 wherein said motorized linear stage includes a piezoelectric transducer (PZT) PZT-driven linear stage.

10. The multiple zone plates precision alignment apparatus as recited in claim 9 wherein said PZT-driven linear stage includes an ultrasonic piezo-motor with a linear optical encoder.

11. The multiple zone plates precision alignment apparatus as recited in claim 1 wherein each said respective positioning stage includes three positioning stages to adjust position of said respective zone plate holder in X, Y, and Z directions.

12. The multiple zone plates precision alignment apparatus as recited in claim 1 wherein each of said three positioning stages includes a motorized linear stage.

13. The multiple zone plates precision alignment apparatus as recited in claim 1 wherein said zone plates include Fresnel zone plates (FZPs).

14. The multiple zone plates precision alignment apparatus as recited in claim 1 includes a symmetric base structure.

15. The multiple zone plates precision alignment apparatus as recited in claim 1 wherein said symmetric base structure is formed of a nickel-iron alloy invar.

16. The multiple zone plates precision alignment apparatus as recited in claim 1 includes a non-symmetric base structure.

17. The multiple zone plates precision alignment apparatus as recited in claim 16 wherein said non-symmetric base structure is formed of a nickel-iron alloy invar.

18. The multiple zone plates precision alignment apparatus as recited in claim 1 wherein each said linkage component is formed of a selected single material or a selected combination of materials.

19. The multiple zone plates precision alignment apparatus as recited in claim 18 wherein said single material and said combination of materials forming each said linkage component includes an aluminum alloy, titanium, a copper alloy, a nickel-iron alloy invar, a stainless steel material, and a carbon steel material.

20. The multiple zone plates precision alignment apparatus as recited in claim 1 includes a respective pair of fasteners arranged for thermal expansion compensation respectively connecting said respective linkage component and said positioning stage, and said respective linkage component and zone plate holder including a spring loaded fastener providing a sliding connection and a second fastener without spring loading providing a tight connection.

* * * * *